US006332547B1

(12) United States Patent
Shaw et al.

(10) Patent No.: US 6,332,547 B1
(45) Date of Patent: Dec. 25, 2001

(54) INDEXABLE GRAVITY FLOW SHELVING SYSTEM

(75) Inventors: Kenneth Alfred Shaw, Lombard; Henry J. Massett, Jr., Evergreen Park, both of IL (US)

(73) Assignee: B-O-F Corporation, Aurora, IL (US)

( * ) Notice: Subject to any disclaimer, the term of this patent is extended or adjusted under 35 U.S.C. 154(b) by 0 days.

(21) Appl. No.: 09/381,142

(22) PCT Filed: Jun. 21, 1999

(86) PCT No.: PCT/US99/13977

§ 371 Date: Sep. 14, 1999

§ 102(e) Date: Sep. 14, 1999

(87) PCT Pub. No.: WO00/78180

PCT Pub. Date: Dec. 28, 2000

(51) Int. Cl.[7] ..... A47F 7/00
(52) U.S. Cl. ..... 211/59.2
(58) Field of Search ..... 211/59.2, 59.3, 211/184; 108/60

(56) References Cited

U.S. PATENT DOCUMENTS

| | | | | |
|---|---|---|---|---|
| 2,915,193 | | 12/1959 | Bromberg . | |
| 3,004,814 | | 10/1961 | Schulze . | |
| 4,270,661 | * | 6/1981 | Rosenband | 211/59.2 |
| 4,383,614 | | 5/1983 | Miller . | |
| 4,394,910 | | 7/1983 | Miller . | |
| 4,592,471 | | 6/1986 | Bross . | |
| 4,729,481 | | 3/1988 | Hawkinson et al. . | |
| 4,881,787 | | 11/1989 | King et al. . | |
| 4,896,779 | * | 1/1990 | Jureckson | 211/184 |
| 4,909,402 | | 3/1990 | Highsmith . | |
| 5,022,535 | | 6/1991 | Spamer . | |
| 5,088,607 | * | 2/1992 | Risafi et al. | 211/59.3 |
| 5,119,945 | * | 6/1992 | Wiggins | 211/184 |
| 5,199,584 | | 4/1993 | Fowler et al. . | |
| 5,242,223 | | 9/1993 | Koves . | |
| 5,279,430 | | 1/1994 | Benton . | |
| 5,360,122 | | 11/1994 | Benton . | |
| 5,450,968 | * | 9/1995 | Bustos | 211/59.2 |
| 5,458,248 | | 10/1995 | Blain . | |
| 5,474,412 | | 12/1995 | Pfeiffer et al. . | |
| 5,595,310 | * | 1/1997 | Spamer et al. | 211/59.2 |
| 5,673,801 | | 10/1997 | Markson . | |
| 5,806,689 | * | 9/1998 | Mays et al. | 211/59.2 |
| 5,839,588 | | 11/1998 | Hawkinson . | |
| 5,845,794 | | 12/1998 | Highsmith . | |
| 5,887,732 | * | 3/1999 | Zimmer et al. | 211/59.2 |
| 6,082,556 | * | 7/2000 | Primiano et al. | 211/59.2 |
| 6,105,798 | * | 8/2000 | Gruber et al. | 211/59.2 |

FOREIGN PATENT DOCUMENTS

| | | |
|---|---|---|
| 7402398 | 11/1974 | (DE) . |
| 196 22 824 | 5/1997 | (DE) . |
| 196 09 432 | 9/1997 | (DE) . |

* cited by examiner

*Primary Examiner*—Alvin Chin-Shue
*Assistant Examiner*—Sarah Purol
(74) *Attorney, Agent, or Firm*—Marshall, Gerstein & Borun

(57) ABSTRACT

An indexable gravity flow shelving system provides resilient comb members along the front and rear rails of each inclined shelf to removably and releasably secure track members to the inclined shelf. Each resilient comb includes a row of downwardly-extending tangs that define slots therebetween to receive elongated flow ribs extending the length of the upper surface of each track member. The tangs contact the sides of the elongated flow ribs and prevent transverse movement of the track members. The spacing of the tangs allow for the shelving system to be used effectively with track members besides track members having elongated flow ribs. The resilient comb members deform and rebound to readily allow for rearrangement of track members within each inclined shelf. The resilient comb members can cooperate with price tag moldings along the front and rear rails of the inclined shelf. The price tag moldings provide means for mounting labeling indicia in close proximity to columns of product units stored on the shelf, as well as means for receiving stop plates along the front and, if desired, the rear of the shelf to prevent unwanted spillage of product units. A desirable alternate embodiment utilizes adapter means to allow retrofitting an existing cantilevered gondola-type shelf with resilient comb members to form front and rear track interface means and convert the existing shelf into an indexable gravity flow shelf.

40 Claims, 6 Drawing Sheets

INDEXABLE GRAVITY FLOW SHELVING SYSTEM

BACKGROUND OF THE INVENTION

1. Field of the Invention

This invention relates generally to gravity flow shelving units and, more specifically, to inclined shelves having adjustable track members for ready manipulation of horizontal spacing and location of track members in gravity flow shelves to accommodate product of various shapes and sizes, so as to maximize use of retail shelf space.

2. Description of the Related Art

In order to increase inventory turnover and maximize efficient use of shelf space, retailers increasingly utilize gravity flow shelving systems, wherein inclined shelves are used to stock merchandise. In such shelf systems, consumers are presented with an array of merchandise arranged in parallel tracks on each shelf, generally with only the front-most (or "first-up") unit of merchandise in each individual track being easily accessible. Upon removing this front-most unit of merchandise, the remaining units of like-merchandise in that given track advance, i.e. slide down, toward the front of the shelf, so that the next-successive unit in line becomes the new front-most unit in that track.

Since conventional flat merchandise shelves, e.g., cantilevered or so-called "gondola"-type shelves, allow users to rearrange product on the shelves, such as to find product with later expiration dates, these inclined gravity flow shelving systems help ensure that oldest product is sold first. By making rearrangement of product more difficult, it is found that inventory waste is reduced. The inclined arrangement of the gravity flow shelves also allows greater shelf-space on a given footprint of valuable floor space for the retailer, which is a particular advantage in relatively costly refrigerated aisles and wall units where gravity shelving systems are becoming the industry standard.

In order to further maximize the use of shelf space, various attempts have been made to provide adjustable or indexable shelving, wherein individual track members are horizontally adjustable relative to a shelf frame, so that track members can be placed by a retailer at different customized desired horizontal locations to accommodate merchandise of varying size, i.e. width, and shape on a single inclined shelf.

The general concept of indexable shelf tracks for display shelves started as early as the late 1950's, where Bromberg, U.S. Pat. No. 2,915,193, showed the use of horizontally-spaced, upwardly- and inwardly-open slots along the front and rear of a flat shelf to accommodate vertical wall members at various desired spaced locations along the width of the shelf to form several compartments of desired sizes within the shelf. A shortcoming of such a shelf with variable width spacings, when utilizing upwardly-open slots to receive vertical wall members, is that the wall members can be easily removed by consumers, thereby easily circumventing the purpose of the vertical wall members.

Indexable shelf tracks have also been used in inclined gravity flow racks, such as in U.S. Pat. No. 4,383,614, which shows a plurality of teeth defining inwardly-open notches along the front and rear rails of an inclined shelf to securely receive individual roller track members to facilitate sliding of products on the track members. Each of the roller track members has an inverted generally U-shaped cross-section, with a flat top web having downwardly-projecting straight legs and inwardly-bent runners. The runners slidably receive a plastic clip member to lock the track member in place within a pair of the inwardly-open notches. Such clip members must be separately manufactured, increasing time and cost of production, as well as providing many additional parts for assembly (and possibly inadvertent loss of smaller parts) by the retailer.

In another previous attempt at an indexable gravity flow shelving system, shown in Highsmith, U.S. Pat. No. 4,909,402, longitudinal dividers having resilient legs are received between pegs having upright and transverse portions that define upwardly-open notches. In localized regions, the resilient legs of the longitudinal dividers are biased together by a clip in order to pass the longitudinal divider between desired adjacent pegs, and then the clip is removed to lock the longitudinal dividers in place. Again, a clip member is necessary to assemble the indexable shelf member. In this instance, since the clip is only used at the time of assembly or removal of a longitudinal divider, the clip may again inadvertently become lost, rendering rearrangement of the longitudinal dividers difficult. Furthermore, additional track members to support merchandise are required.

Most all conventional indexable gravity flow shelf systems require the use of track members specially adapted with legs or flanges on the underside thereof to be received in the indexing slots provided along the front and rear rails of the shelf. These legs or flanges are integral parts of the track members, such as shown in German Patent No. 196 09 432, requiring costly machine operations to form the track members having the required shape. As indicated in that German patent, gravity flow shelf tracks can utilize elongated grooved channels along the length of the track members order to reduce friction between merchandise and the upper flat surface of the track. Alternatively, as shown in Spamer, U.S. Pat. No. 5,022,535, elongated, upwardly-extending flow ribs or runners can be provided along the upper flat surface of the track members, which similarly serve to reduce friction between merchandise and the track members. Spamer discloses using adhesive to mount the shelf tracks to the front and rear rails of the inclined shelf, which can undesirably deteriorate over time.

It would be desirable for an indexable gravity flow shelf system to have the ability to utilize the existing flow ribs or slide runners on the upper surface of the track members to lock track members in desired locations along inclined shelves, because such use would eliminate the need for additional legs or flanges on the underside of the track members. However, there is no known prior gravity flow shelving system that uses the friction-reducing flow ribs on the upper surface of the tracks for securely installing the track members.

Another drawback of conventional indexable shelf systems is that the horizontal adjustability of the individual shelf tracks is limited by relatively wide spacing of the slots or apertures heretofore provided on front and rear rails to receive portions of the tracks. A typical center-to-center distance of about 5/16" separates inwardly-open notches between the teeth members along the front and rear rails of finite horizontally-adjustable (i.e., indexable) gravity flow rack systems found in the prior art. However, it would be desirable for an indexable gravity flow shelf system to provide a greater number of shelf track interface points that are spaced more closely together than in such prior art indexable shelf systems, in order to achieve greater finite horizontal adjustability of track members.

It would also be useful to have an indexable gravity flow shelf system that is easy to assemble and for which the individual shelf tracks can be easily rearranged by the retailer, yet still be securely mounted in place once arranged to avoid inadvertent shelf track slippage or dislocation. It would be further desirable if such a shelf track system required no additional clip parts to lock shelf tracks in place or to install (or remove) shelf tracks in (from) desired locations along the width of the shelf. An additional desirable feature would be the ability to retrofit an existing shelf with components that allow the shelf to act as an indexable gravity flow shelf that does not suffer from the drawbacks described above. The manner in which these objectives are accomplished by the present invention is described in the following Brief Summary of the Invention, the Detailed Description of the Invention, and the drawings.

BRIEF SUMMARY OF THE INVENTION

The present invention utilizes a row of generally downwardly-extending resilient tangs that forms a resilient comb member along both the front and rear rails of each inclined shelf in a gravity flow shelving system. In general, when installing certain types of track members, a region of at least one of these rows of resilient tangs flexes outwardly while an individual track member is being installed, and then snaps closed, i.e. springs back or returns to its original position, once a flat surface of the track member passes beneath the selected series of tangs. Advantageously, the elongated, upwardly-extending flow ribs or slide runners which are provided along the upper flat surface of each of these certain types of track members are received in slots or gaps between pairs of the downwardly-extending resilient tangs to prevent unwanted lateral, i.e. transverse, movement of the track members, once arranged in a shelf.

Various shapes of track members having the upwardly-extending ribs can be utilized, such as flat track members, inverted T-shaped track members, L-shaped track members, and even others. The elongated body of the inverted T-shaped track members provides an integral vertical divider portion used to separate adjacent tracks of the shelf, keeping merchandise in its respective track. The L-shaped track member is used for the outside tracks of a given shelf, and provides the vertical divider portion for keeping merchandise in an outer end (i.e., left-most or right-most) column. It is the vertical divider portion of the inverted T-shaped track members and the L-shaped track members that causes the outward deformation of a region of one of the front and rear rows of resilient tangs during insertion or removal of the track members.

The exposed leading front (or rear) edge of the vertical divider portion of these track members engages a peak of a gap between a pair of the resilient tangs and deforms a region of the associated row of tangs that is wide enough to provide clearance for the flat runner portion of the track member to pass beneath the row of tangs, at which time the deformed region of the row of resilient tangs snaps back to its original position and the track member can be slid toward the opposite rail to be locked in position at that same end of the shelf.

In a preferred method of using the indexable shelf system of the present invention, a rear end of a track member is placed in a desired horizontal location against the row of resilient tangs along the rear rail of an inclined shelf, so that the upwardly-extending ribs on the upper flat surface of the track member are aligned with slots between pairs of the resilient tangs along the rear rail. Pressure is then applied longitudinally along the track member to rearwardly bias the region of resilient tangs in the vicinity of the vertical divider portion at the rear end of the track member, until the rear end of the track member passes below the resilient tangs adjacent to the rear end of the track member. At this time, this bent region of resilient tangs springs back to its original orientation. Finally, the track member is slid forwardly along the inclined plane of the shelf until the front end of the track member passes under the tangs along the front rail of the inclined shelf, or the front end of the track member is simply snapped downwardly into tangs at the front rail of the inclined shelf, to be releasably locked at that desired location within the shelf.

Advantageously, to remove the track member, the process is readily reversible, in that the track member is slid in a rearward direction, applying adequate force to bias the region of the row of resilient tangs adjacent the rear rail of the shelf rearwardly until the front end of the track member is clear of the resilient tangs along the front rail of the inclined shelf. The track member is then withdrawn from underneath the resilient tangs along the rear rail of the shelf. It will be understood that the track members can alternatively be installed or removed in the opposite directions to those just described.

Preferably, each of the front and rear rails of the indexable shelf of the present invention cooperates with a price tag molding having a horizontal channel that is generally U-shaped in cross-section to receive and retain a stop plate or filler piece in a position generally perpendicular to the plane of the inclined shelf. The front end stop plate is an acrylic, preferably transparent plate that is inserted in the U-shaped channel of the front price tag molding, and extends above the front price tag molding in order to prevent merchandise from falling of the shelf at the front end of each track member. Because of the height of the rear rail and angle of incline of the indexable shelf, a stop plate at the rear of the shelf is not necessary to prevent a rear-most (or "last-up") product unit in a given column of product units from being pushed off the rear side of the shelf system when pressure is applied to the first-up product unit in that column of units from the front of the shelf system, for example if the shelves are front-loaded.

However, the use of an elongated filler piece, preferably plastic, in the U-shaped channel of the rear price tag molding is necessary to keep the resilient adjustment tangs of the rear of the shelf at a distance above the rear rail that is approximately the same as the distance of the tangs of the front of the shelf above the front rail. The front resilient adjustment tangs may be provided as integral downwardly and rearwardly-extending tooth-like projections of the front price tag molding or, more preferably, as downwardly and rearwardly-exending tooth-like projections that are part of a separate resilient comb member having a means for interlocking with the front price tag molding.

In either case, the gaps between the tangs of each comb member preferably have a center-to-center distance of 0.2", which is shorter than the 5/16" center-to-center spacing of many of the track-receiving gaps found in indexable shelving in the prior art. This closer spacing of the gaps between the tangs vastly increases the horizontal adjustability of the track members, so that the system can be better customized by retailers for their use with products of various widths.

Advantageously, a price plate receiving channel at the forward leading edge of the price tag molding can receive labeling indicia therein, such as product names, flavors, and prices, at positions associated with, i.e. immediately forwardly and below, each track member of the shelf for the benefit of consumers.

The resilient adjustment tangs along the rear rail are aligned with the resilient adjustment tangs of the front rail to assure proper alignment of the track members, and are formed as forwardly-extending tooth-like projections of either a rear price tag molding or, more preferably, a separate resilient comb-like member that interlocks with the rear price tag molding. Indicia may be provided on the individual tangs associated with the front rail, with corresponding indicia on the tangs associated with the rear rail, to further facilitate quick proper alignment of the track members. For example, a colored marking can be provided on every fifth tang along both the front and rear rails so that a retailer can easily align each track member at a desired horizontal location within the shelf. The price tag molding on the rear rail may also include a price plate receiving channel to receive rearwardly-facing indicia therein, such as product codes, product names, and flavors, to assist stock-keeping personnel in stocking items from the rear of the shelf. Again, these indicia may be provided in close proximity to associated track members.

More generally, it is recognized that the flexible track interface means of the shelf frame of the present invention can be used to secure various other types, i.e. designs, of track members, including those that do not have the upwardly-extending flow ribs. For example, the spacing of the tangs along each comb member are preferably such that the shelf frame can accommodate elongated roller track members found in the prior art, preferably having an inverted generally U-shaped cross-section including a flat top web having downwardly-projecting vertical side legs. Such elongated roller track members further include inwardly-bent flanges along the bottom of each side leg.

The vertical side legs serve the same function as the vertical divider portion of the L track member and inverted T track member described above. Each vertical side leg contacts the peak of a gap between two adjacent tangs, and when pressure is applied longitudinally along the length of the roller track member, a region of the corresponding comb member deforms outwardly so that the opposite end of the roller track member can be snapped in place along the opposite rail of the shelf frame. The length of the roller track member is such that when installed, i.e. snapped in place, between opposing tangs of the front and rear comb members, the roller track member is securely restrained against transverse movement.

In an alternate embodiment of the present invention, an existing cantilevered, so-called "gondola"-type shelf is retrofitted with components to convert the shelf into an indexable gravity flow shelf. The components include front and rear flexible track interface means of the type described above. Advantageously, mounting arms located on the rear of the gondola-type shelf can be used to mount the shelf at an incline, leaving space at the rear of the shelf for one or more generally J-shaped hooks to clip the front and rear flexible track interface means to the flat shelf surface.

DETAILED DESCRIPTION OF THE INVENTION

Figures 1, 2:
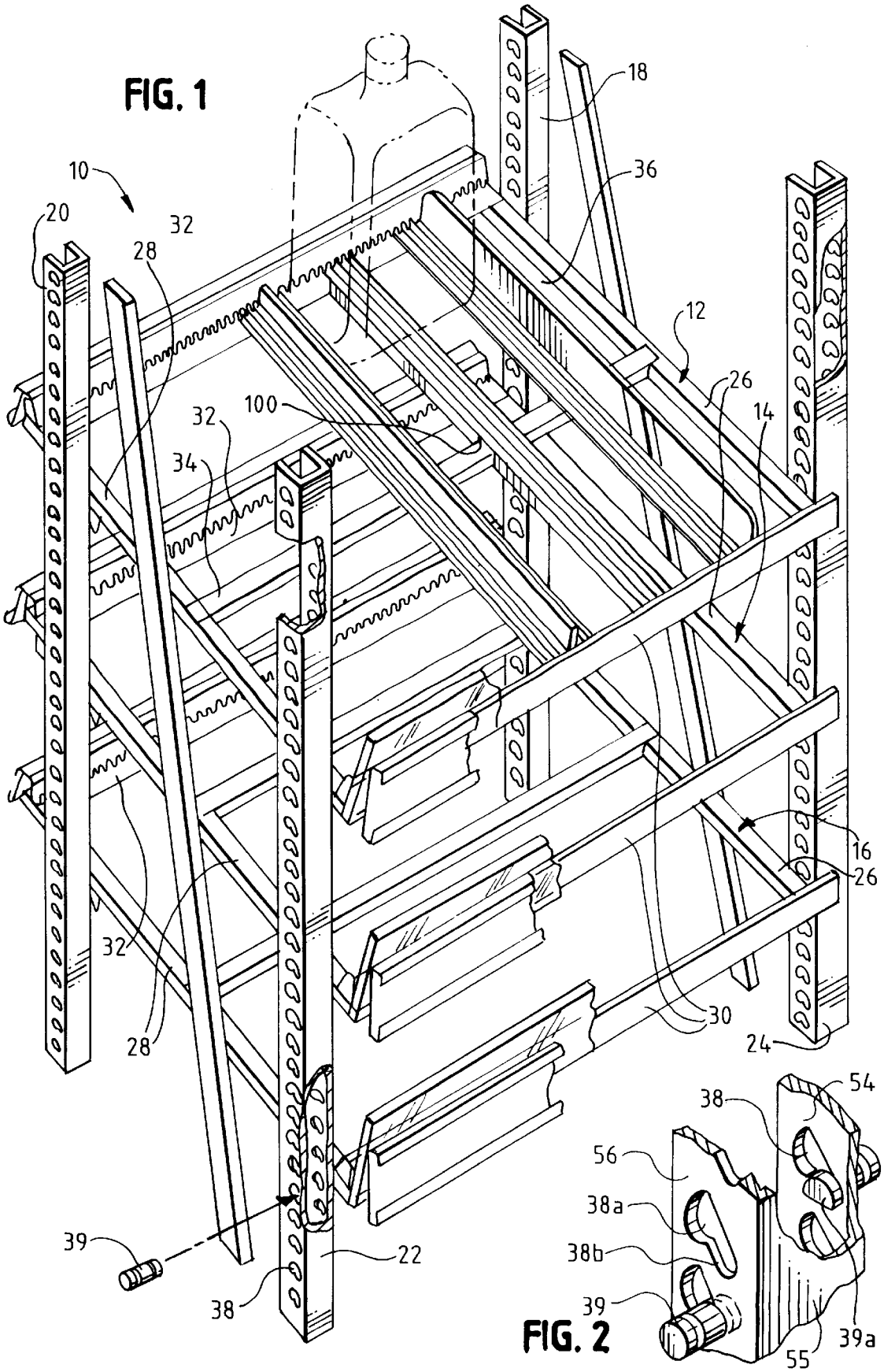
FIG. 1 is a perspective view of an indexable gravity flow shelf system of the present invention.
FIG. 2 is an enlarged front perspective view, broken away, of a preferred vertical support for the gravity flow shelf system shown in FIG. 1, with shelf mounting clamps.

As shown in FIGS. 1–4, an indexable gravity flow shelf system 10 includes three inclined shelf frames 12, 14, 16 mounted on four vertical shelf rack support legs 18, 20, 22, 24. Fewer or more inclined shelf frames may be utilized in the shelf system 10, as desired, and as allowed by the height of both the vertical shelf rack support legs 18–24 and the height of product stored on the shelf frames. Each shelf frame 12, 14, 16 includes a pair of side rails 26, 28, a front rail 30, and a rear rail 32. The front, rear, and side rails may be L-shaped in cross section, as described in more detail below. A center rail 34 is also preferably provided in each shelf frame for extra support of the track members. Additional intermediate lateral cross rails (not shown) may be provided horizontally across the width of the shelf 12 to provide additional support. The side rails 26, 28 are each provided with a plurality of downwardly-directed, inclined U-shaped mounting grooves 36 that are selectively hooked onto clamps fastened to the rear vertical support legs 18, 20 in order to adjust the angle of incline of the shelf frame 12. Mounting grooves 36 may also be used to adjust how far the shelf frame 12 extends forwardly of the front vertical support legs 22, 24.

Vertical Support Legs

Keyhole slots 38 that receive the clamps 39 (or similar fasteners as will be appreciated by those of ordinary skill in the art) are preferably provided along substantially the entire length of each of the vertical support legs 18, 20, 22, 24 to provide maximum adjustability for shelf height, number of shelves, and angle of incline of each shelf frame 12, 14, 16. As shown in FIG. 2, each clamp 39 may be in the form of a generally cylindrical member having a pair of spaced annular grooves therein. A relatively wide entry/exit portion 38*a* of the keyhole slot 38 receives a complementarily-shaped support lock end 39*a* of the clamp 39, and an adjacent annular groove of the clamp 39 slides into a relatively narrow channel 38*b* of the keyhole slot. The other annular groove of the clamp 39 receives a portion of one of the side rails 26, 28 of the shelf frame, or permits coupling of the clamp 39 with one of the U-shaped mounting grooves 36.

Gravity retains the clamp 39 in a secure position. Preferably, each vertical support leg 18, 20, 22, 24 is generally U-shaped in cross section, with a solid, imperforate central web portion 55 flanked by two side walls 54, 56. The keyhole slots 38 preferably extend along both of the sidewalls 54, 56 of the vertical support legs 18–24, which permits front and rear vertical support legs to be shared by adjacent shelf rack systems 10, thus facilitating the forming of an aisle of multiple, cooperating, side-by-side gravity flow shelf rack systems.

Advantageously, each of the vertical support legs 18, 20, 22, 24 is preferably generally U-shaped in cross-section, with a central web 17 and side legs 19, 21. The keyhole slots 38 are preferably provided along both vertical side legs 19, 21, so that a single vertical support leg may be used cooperatively for two adjacent shelf systems, and an entire row of shelf systems may thus be interlinked. For cosmetic reasons, the central web 17 of each vertical support leg 18, 20, 22, 24 faces the front of the shelf system 10, to obscure the keyhole slots 38 and clamps 39 from view. While this type of vertical support leg, keyhole slot, and clamp system has been used in gravity flow shelving systems prior to the present invention, this structure is disclosed as one preferred exemplary environment for the shelf frame of the present invention.

"Price Tag" Moldings

Figure 6:
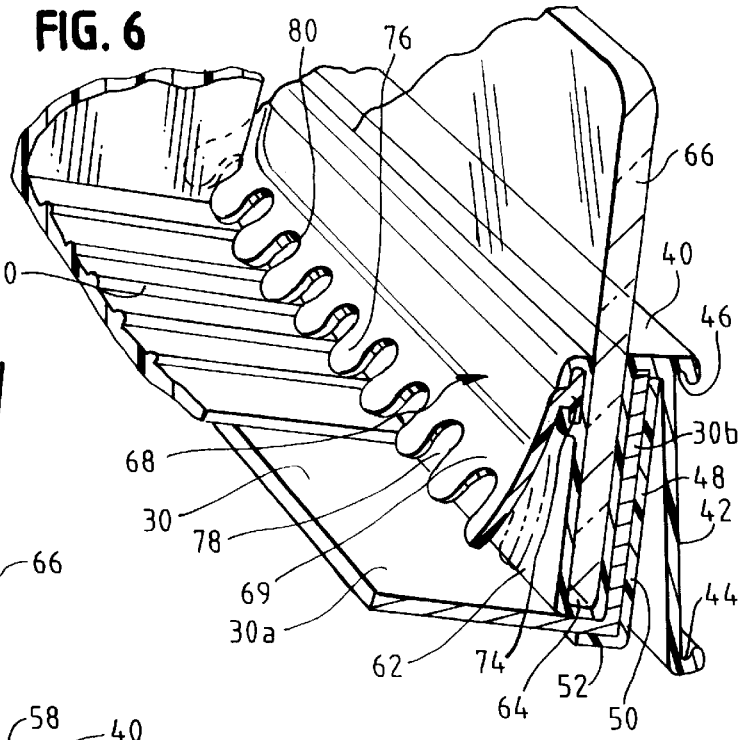
FIG. 6 is a perspective view, broken away, of an interface of an inverted T-shaped track member and the front track interface means of the shelf shown in FIG. 4, taken along line 6 of FIG. 4.
Figure 5:
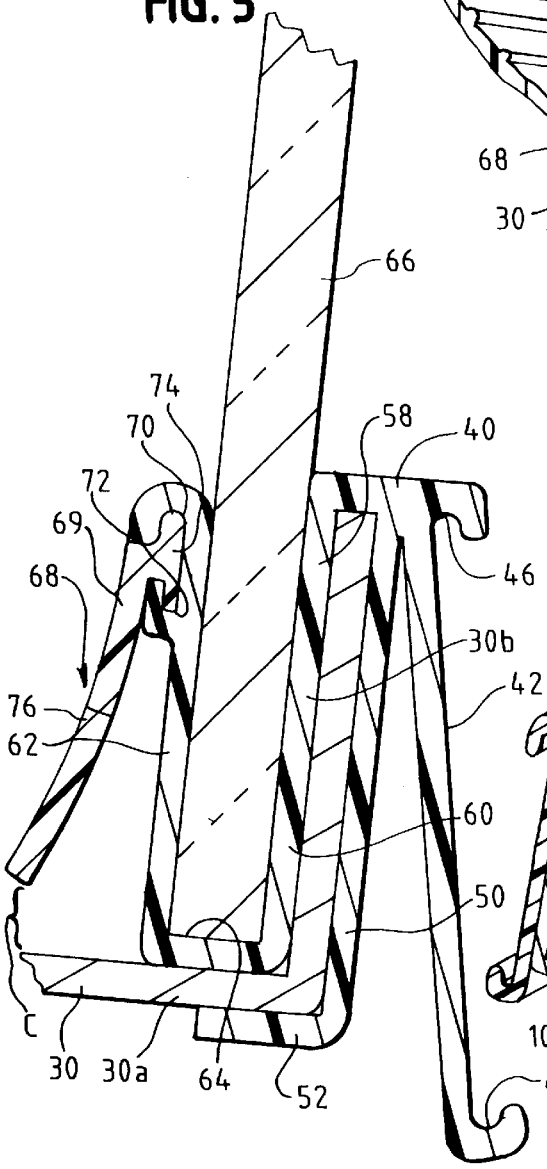
FIG. 5 is a left side view of the front rail of the shelf shown in FIG. 3, taken along lines 5—5 of FIG. 3.
Figure 7:
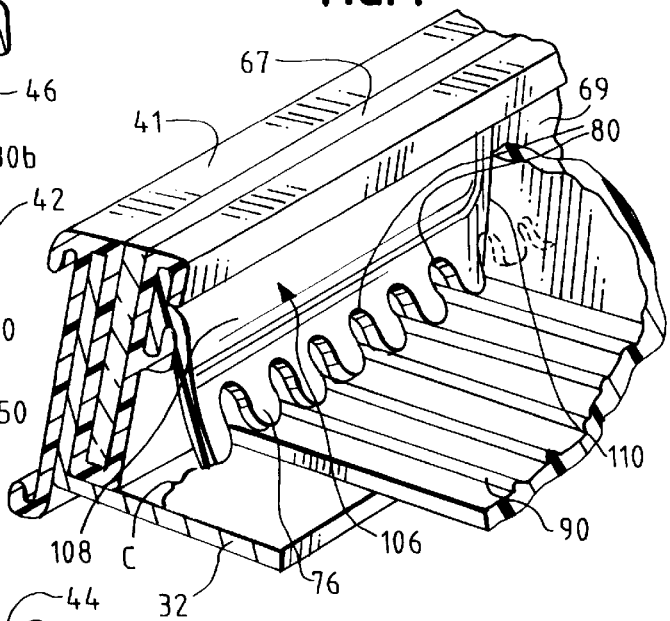
FIG. 7 is a perspective view, broken away, of an interface of an L-shaped track member and the rear track interface means of the shelf shown in FIG. 3, taken along line 7 of FIG. 3.

Turning to FIGS. 5–7, a flat portion 30*a* of the front rail 30 lies in the plane of the shelf frame 12, and an upstanding portion 30*b* of the front rail 30 interfaces with a specially adapted elongated price tag molding 40 that extends substantially the width of the shelf frame 12. The price tag molding 40 derives its name because its leading portion 42, which is the portion visible to the consumer, includes opposing lower and upper channels 44, 46 to receive labeling indicia therein, such as pricing information, product identification, and inventory control numbers. Most preferably, the price tag molding 40 is made of Acrylonitrile Butandiene Styrene (ABS), which is available from Bayer Corp., Rosemont, Ill. The leading portion 42 is integrally joined just rearwardly of the upper channel 46 to a secondary portion 48 of the price tag molding 40.

Secondary portion 48 is preferably L-shaped in cross-section, in that it includes a wall member 50 that is substantially perpendicular to the inclined plane of the shelf frame 12 and a relatively short, flat, rearwardly-directed extension 52 that lies in the same inclined plane as the shelf frame 12 to lock the price tag molding 40 in place on the L-shaped front rail 30. A short gap separates the second portion 48 from a tertiary portion 58 of the price tag molding 40, consisting of a first wall 60, a second wall 62 parallel to the first wall 60, and a floor segment 64 separating the first wall 60 and the second wall 62. The first wall 60, second wall 62, and floor segment 64 define generally U-shaped groove that can receive and retain a front stop plate 66 in an orientation generally perpendicular to the plane of the shelf frame 12. The front stop plate 66 is preferably a transparent acrylic plate that extends above the top of the front price tag molding so that the first-up product stored in each column on shelf tracks 82, 84, 86 (which are described in more detail below) is visible to consumers, while being prevented from falling over the leading portion 42 of the price tag molding 40. The front stop plate 66 is preferably easily removable from the tertiary portion 58 to facilitate cleaning of the front stop plate 66.

The first wall 60 and floor segment 64 of the tertiary portion 58 cooperate with the wall member 50 and short, flat, rearwardly-directed extension 52 of the secondary portion 48 to securely receive the upstanding portion 30*b* of the front rail 30 and lock the price tag molding 40 in place on the front rail 30.

Figure 3:
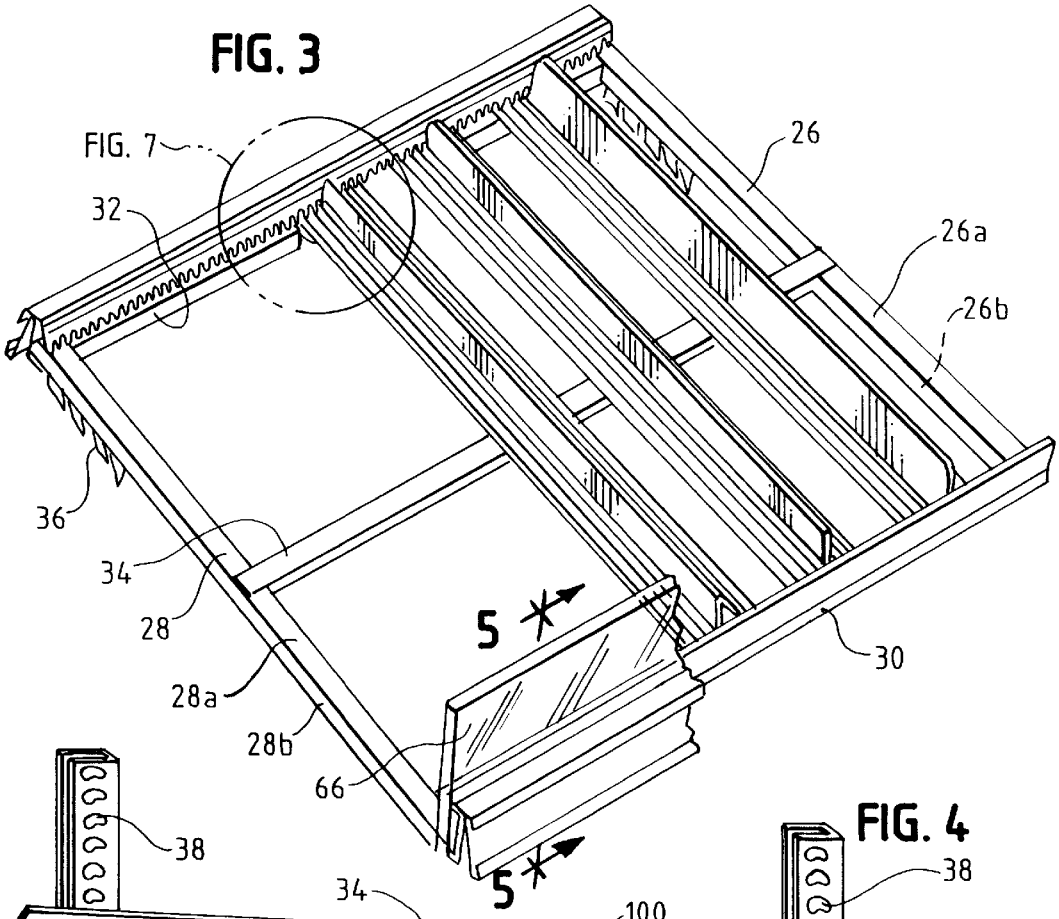
FIG. 3 is a front perspective view of a single indexable gravity flow shelf of the present invention.
Figure 4:
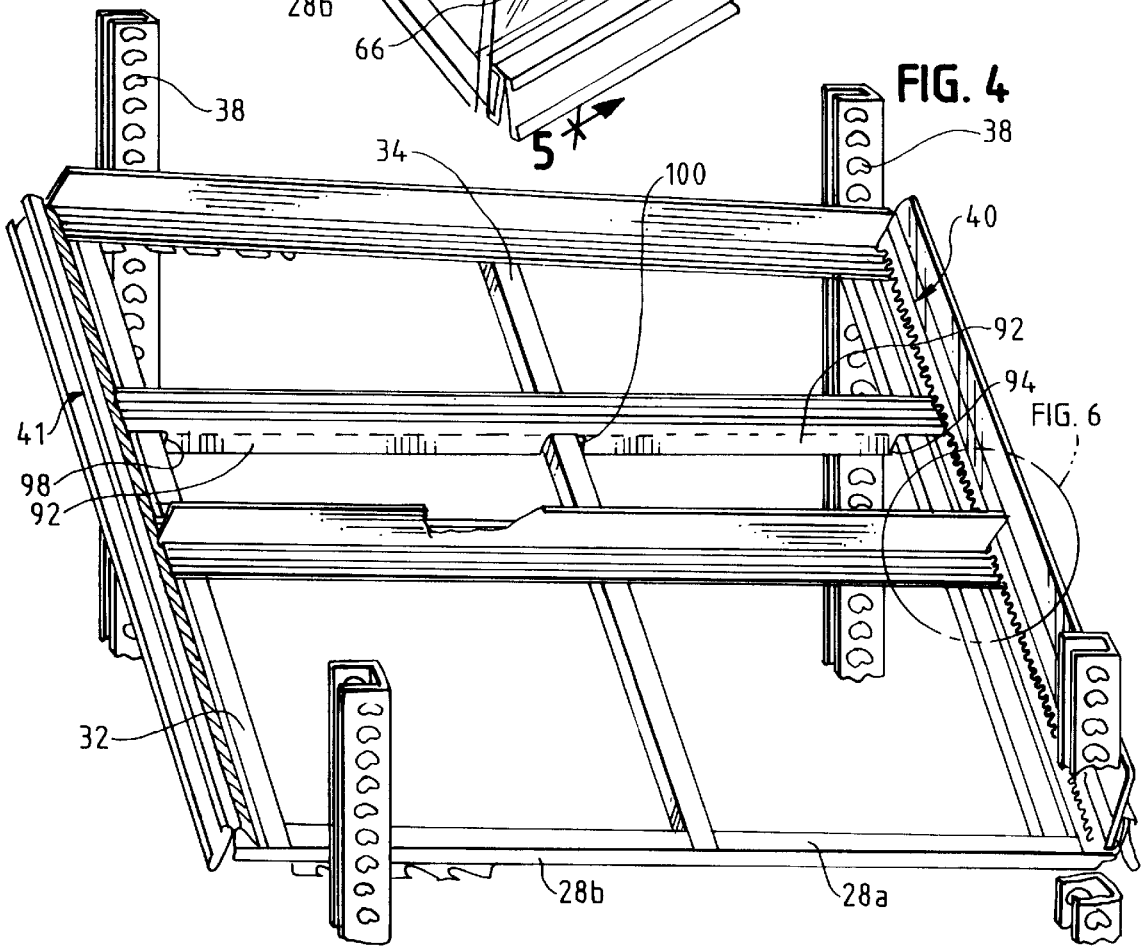
FIG. 4 is a left, rear perspective view of a single indexable gravity flow shelf of the present invention.

Because the side rails 26, 28 are connected to the underside of the flat portion 30*a* of the front rail 30, it is recognized that a portion of the rearwardly-directed extension 52 of the secondary portion 48 may need to be removed at each side of the front rail 30 to accommodate the width of the flat portion 26*a*, 28*a* of each of the respective side rails 26, 28 that lies in the plane of the shelf frame 12 (see FIGS. 2, 3). The side rails 26, 28 are also preferably L-shaped, with an integral downwardly-extending portion 26*b*, 28*b* from which the generally U-shaped mounting grooves 36 depend.

Immediately rearward of the tertiary portion 58 of the price tag molding 40 is support means for a front track interface means 68. In the most preferred embodiment, this support means for the front track interface means includes closely-spaced opposing upper and lower channels 70, 72 located along the second wall 62 of the tertiary portion 58. These opposing channels 70, 72 form a C-shaped (in cross-section) passageway that slidingly receives a corresponding T-shaped (in cross-section) extension 74 of the front track interface means 68. Although the front track interface means 68 and the price tag molding 40 are designed to securely interlock with one another without the need for any bonding agents or welds, those of ordinary skill in the art will appreciate that, once assembled, these components can also be crimped together by the manufacturer for added integrity. Alternatively, the front track interface means 68 may be formed integral with the price tag molding 40, and connected to the tertiary portion 58, for example by a thin-sectioned, living hinge member (not shown).

The front track interface means 68 takes the form of a resilient comb member 69 having a concave curved cross-section and a plurality of downwardly, inwardly open tangs 76. Each pair of tangs 76 defines a generally inverted U-shaped gap 78 therebetween. Each gap 78 has a peak 80 at its highest point. The gaps 78 between the tangs 76 are separated by a center-to-center distance of 0.2" intervals, which is closer than the 5/16" spacing of adjustable track supports found in the prior art. This closer spacing of the gaps 78 between the tangs 76 results in greater adjustability in horizontal placement of shelf tracks. The tangs 76 are formed as individual struck-out members with the bottom of each tang advantageously spaced a distance C above the flat portion 30*a* of the front rail 30 when the tangs 76 are in their resting position. This is done in order to provide clearance for the flat track strip portion of each shelf track between the bottoms of the tangs 76 and the front rail 30. In an exemplary embodiment, the flat track strip portion has a thickness of preferably about 0.1". The raised flow ribs 90 of the track members 82, 84, 86, each has a height of about 0.063", which gives the shelf track a total thickness of 0.163" at the raised flow ribs 90. Most preferably, distance C is approximately 0.135"±0.01", so that the raised flow ribs 90 are retained within the gaps 78 between associated tangs 76 to prevent transverse movement of the track members. It is recognized, however, that track members having thicker flat track strips may be desirable, e.g., for use with particularly heavy products stocked on the shelving. In such applications, the distance C may have to be greater to accommodate such thicker track members.

A similar specially-adapted elongated price tag molding 41 extends along and securely interfaces with the rear rail 32, extending substantially the width of the shelf frame 12. Because of the height and incline of the rear price tag molding 41, it need not include a raised rear stop plate to prevent last-up product from falling over the rear of the shelf. However, a plastic filler piece 67 (not shown in FIGS. 1–4, but see FIG. 7) is considered necessary in the tertiary portion of the rear price tag molding 41 to ensure that the resilient tangs of the rear price tag molding 41 extend the same dimension C above the flat portion of the rear rail 32. Also, it is desirable for the rear price tag molding 41 to still include an indicia receiving means to assist stockkeeping personnel working from behind the shelf system 10 in identifying where to place product, particularly in rear-loaded gravity flow shelving systems.

Track Members

Figure 8:
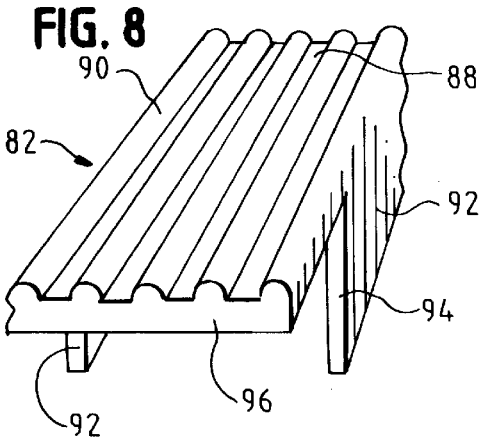
FIG. 8 is a front perspective view, broken away, of a flat track member for use with the indexable shelf of the present invention.
Figure 10:
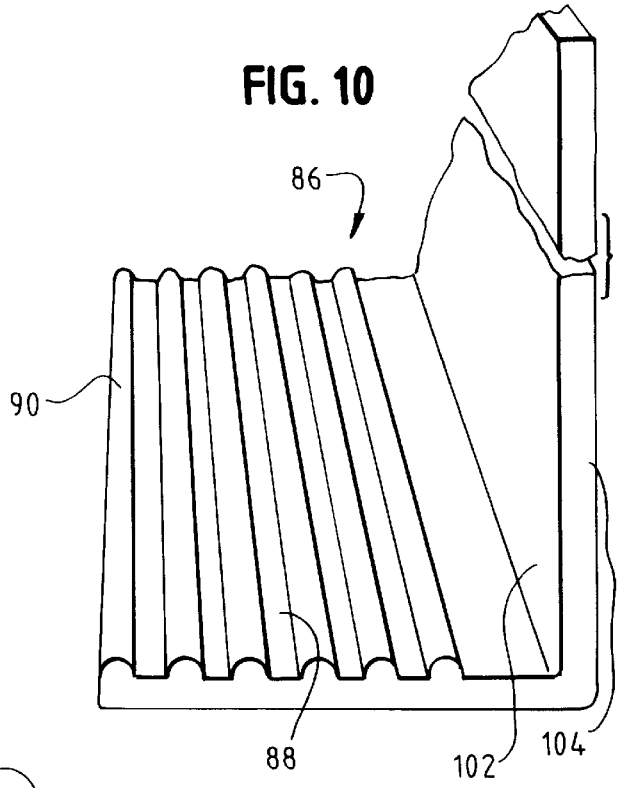
FIG. 10 is a front perspective view of an L-shaped track member for use with an indexable shelf of the present invention.
Figure 9:
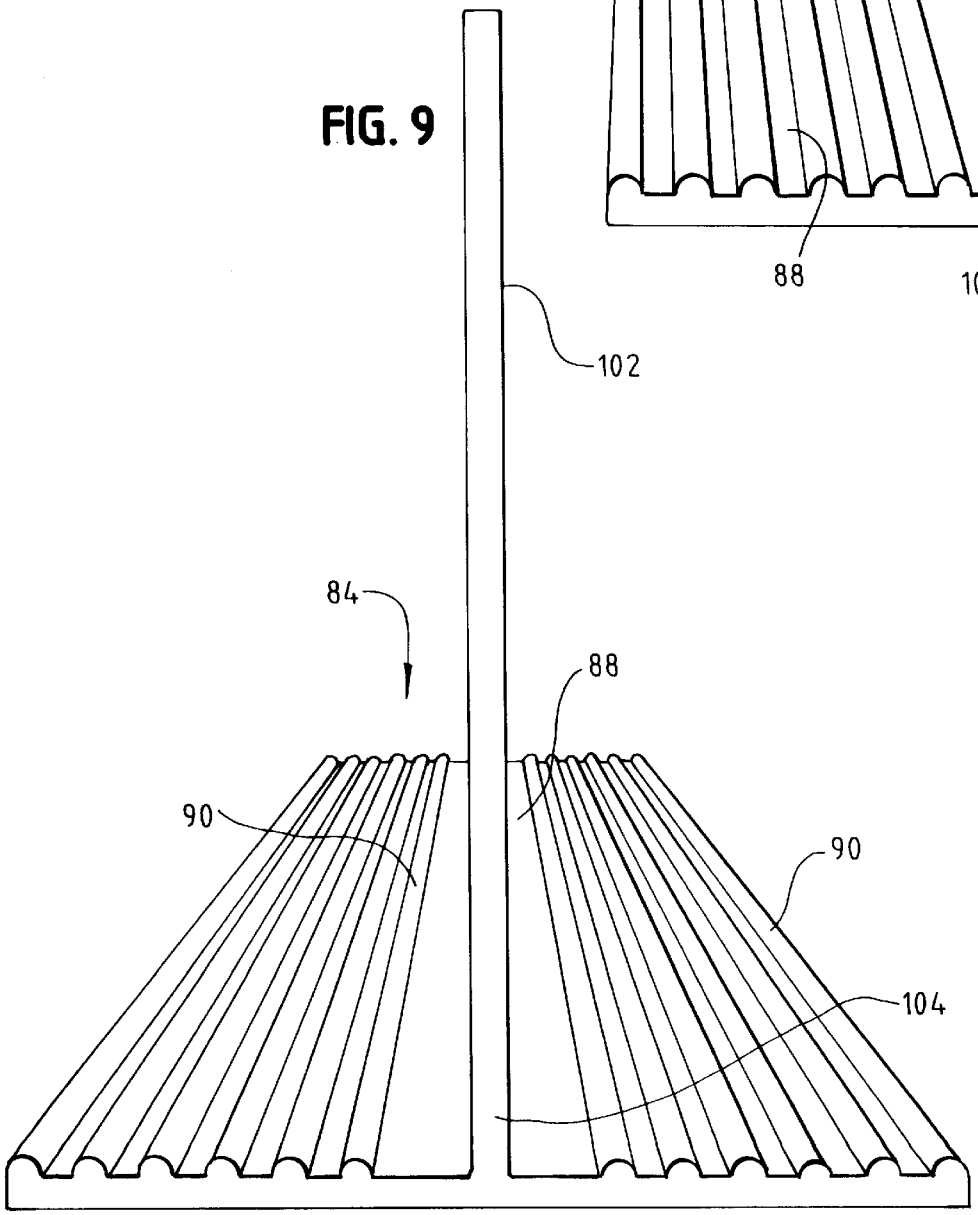
FIG. 9 is a front perspective view of an inverted T-shaped track member, partially broken away, for use with the indexable shelf of the present invention.

Turning now to FIGS. 8–10 three exemplary shelf track members 82, 84, 86 are shown. Each track member 82, 84, 86 is most preferably made of high impact polystyrene, available from Huntsman Chemical Co. of Chesapeake, Va., as well as Dow Corning Co. in Freeland, Mich. The high impact polystyrene may further include an additive, known as Dow Corning #MB25-504. Flat track member 82, shown in FIG. 8, includes a generally flat track strip 88, and a plurality of elongated slide runners or flow ribs 90 extending the length of the upper surface of the track strip 88. The flow ribs 90 reduce the friction between the track strip 88 and product resting on the track member, so that when a first-up unit of product, i.e. a product at the forward- or lower-most position in a column of product units, is removed by a consumer, the remaining product units in the column move, i.e. slide downward, under the force of gravity until the next unit of product in line becomes the new first-up unit by reaching the front stop plate 66.

Unlike the inverted T track member 84 shown in FIG. 9 and the L track member shown in FIG. 10, the flat track member 82 preferably includes at least two downwardly-depending support ridges 92. Each of the support ridges 92 terminates at a front end 94 that is rearward of the front end 96 of the flat track member 82, and terminates at a rear end 98 that is forward of the rear end of the flat track member 82. This is done to provide clearance for the flat track strip 88 to lie flush against the flat portion 30*a* of the front rail 30. Similarly, a central gap 100 is preferably provided in each of the ridges 92 so that the flat track strip 88 lies flush against the center rail 34. Additional gaps (not shown) may be provided in the ridges 92 if the shelf frame 12 requires additional intermediate cross support rails. The ridges 92 advantageously add rigidity to the flat track member 82.

The inverted T track member 84 similarly has a flat track strip 88 and a plurality of flow ribs 90 extending the length of the upper surface thereof. This track member 84 further includes a vertical divider wall member 102, which separates adjacent columns of product units from one another. The L track member 86 also has a flat track strip 88 and flow ribs 90, as well as an outer vertical divider wall member 104. As seen in FIG. 1, an inverted T track member 84 can be used in conjunction with other inverted T track members to define a plurality of track columns for relatively narrow products, and also in conjunction with L track members 86 to define an outer track column for a given shelf frame 12. For relatively wide products, flat track members 82 are used in conjunction with either or both of the other two types of track members to widen the track columns.

Mode of Operation

In order to install an inverted T track member 84 into a given shelf frame 12, the front portion of the inverted T track member 84 is placed into contact with the front track interface means 68 at a desired location. Preferably, a leading edge 104 of the vertical divider wall member 102 is placed in contact with a peak 80 of one of the gaps 78 between tangs 76. Pressure is applied longitudinally (by the person installing the track member) to the inverted T track member 84 in a downward and forward direction, i.e. toward the lower forward end of the shelf, which causes at least a region of the resilient comb member 69 of the front track interface means 68, which is curved in cross-section, to flex forwardly, thereby allowing the flat track strip 88 to pass underneath the tangs 76. Once the flat track strip 88 passes beneath the tangs 76, the flexed region of the resilient comb member 69 snaps back to its original position, as demonstrated by the directional arrows in FIG. 5. The track member 84 is then slid rearwardly until the opposite end of the track member is secured by the tangs of a similar rear track interface means 106, or alternatively, snapped into a rear comb member 108 of the rear track interface means 106. The upwardly-extending flow ribs 90 are advantageously located in the gaps 78 of the resilient comb members 69, 108, thus the tangs 76 prevent the inverted T track member 84 from making any unwanted transverse, i.e. horizontal movement.

Installation of the L track member 86 is similar to the installation of the inverted T track member 84, in that a leading edge 104 of the vertical divider wall member 102 of the L track member 86 is first placed in contact with one of the peaks 80 between the tangs 76. Next, longitudinal pressure is applied on the L track member 86 in a direction toward the lower forward end of the shelf until a region of the resilient comb member 69 of the front track interface means 68 flexes forwardly. Then, the flat track strip 88 passes beneath the tangs 76 and that flexed region of the resilient comb member 69 snaps back to its original position as the L track member 86 is pushed rearwardly toward the rear track interface means 106, or alternatively, snapped into the rear comb member 108 of the rear track interface means 106. Again, the tangs 76 prevent unwanted transverse movement of the given L track member 86 by releasably trapping the upwardly-extending flow ribs 90 therebetween.

Advantageously, the rear track interface means 106 can function just as the front track interface means 68. Thus, installation of either the inverted T track member 84 or the L track member 86 can be reversed, so that a rear leading edge 110 of the vertical divider wall member 102 of the given track member is first applied to the rear track interface means 106 until a region of the resilient comb member 108 of the rear track interface means 106 flexes. Then, the flat track strip 88 passes beneath the tangs 76, and the region of the resilient comb member 108 of the rear track interface means 106 snaps back to its original position, as the given track member is slid downwardly toward the front track interface means 68 or alternatively, snapped into the comb member 69 of the front track interface means 68.

Regardless of the direction in which the given inverted T track member 84 or L track member 86 is installed, removal, e.g., for horizontal adjustment purposes, of the given track member is a similar process. The given track member is again pushed in the direction of the resilient comb 69, 108 of either the front track interface means 68 or rear track interface means 106 until a leading edge 104, 110 of the vertical wall member 102 applies sufficient pressure to the peak 80 between two tangs 76 and the resilient comb flexes again to provide enough room for an opposite end of the flat track strip 88 of the given track member to be removed from the shelf frame 12.

Because the flat track member 82 lacks a vertical divider wall member, installation of this track member is somewhat different than the inverted T track member 84 and the L track member 86. The flat track member 82 is preferably about ½" longer than the inverted T track member 84 and L track member 86, and as a result, the longer length of the flat track strip 88 of the flat track member 82 is sufficient to temporarily flex the resilient comb member of the front and/or rear track interface means 68, 106 to allow for insertion of the flat track member 82 at a desired location. As before, the tangs 76 prevent transverse movement of the flat track member 82 by trapping the upwardly-directed flow ribs 90 therebetween.

The vertical divider wall member 102 aids in the retention of the L track member 86 and inverted T track member 84 in the gaps 80 between the tangs 76. Since the flat track member 82 does not have the vertical divider wall member, the ½" longer length of the flat track member 82 means the flat track member 82 extends an additional ¼" past the tangs 76 of each of the front and rear track interface means 68, 106, which helps retain the flat track member 82 in the gaps 80. The flat track member 82 is preferably sufficiently flexible, even with the support ridges 92, to be removed from the shelf frame 12 without having to flex the front and/or rear resilient comb members 69, 108 again.

In addition to the flat track member 82, the inverted-T track member 84, and L track member 86, various other track shapes are considered to be within the scope of the present invention. Virtually any track shape that has a flat track strip with a plurality of elongated flow ribs on the upper surface can be used in the gravity flow shelf system 10, so long as the track member is able to cause a region of the front and/or rear track interface means 68, 106 to flex outwardly so that the track member may be received and retained in the shelf frame 12. For example, a track member with two vertical divider walls bounding a central flat track strip with elongated flow ribs, i.e. forming a U-shaped track defining a shelf column of fixed width is feasible. Similarly, a track member may have more vertical divider walls, such as a W-shaped track member with two parallel, fixed-width shelf columns. With such U-shaped and W-shaped track members (not shown), it is foreseeable that product to be dispensed on the gravity flow shelf system 10 could advantageously be shipped to retailers together with the track members as shrink-wrapped, ready-to-dispense columns of product units that are simply unwrapped, and the associated pre-loaded track member snapped in place into a shelf frame 12 of the present invention.

Figure 14:
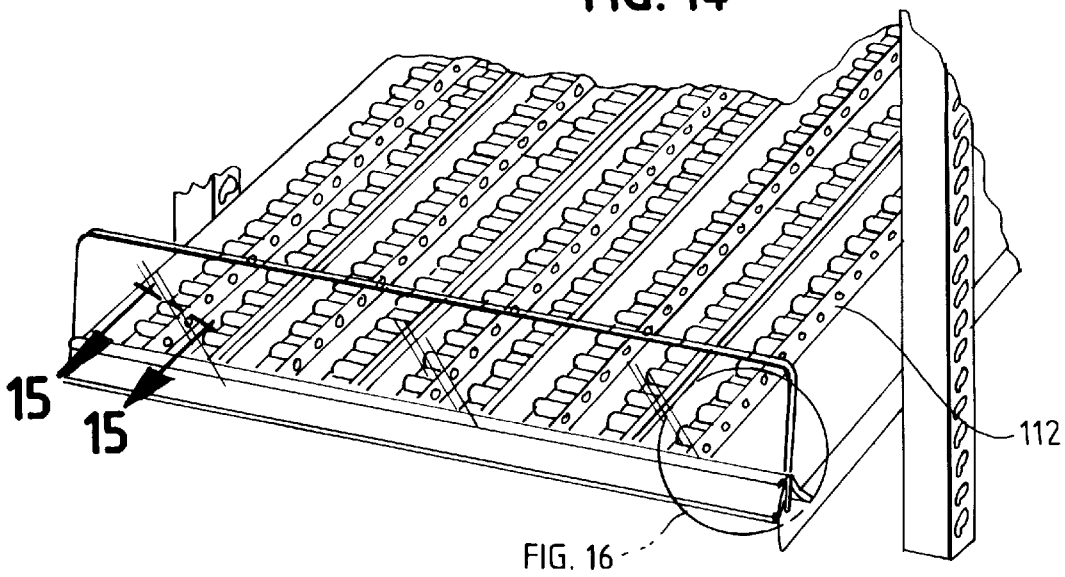
FIG. 14 is a front perspective view, broken away, of an indexable gravity flow shelf of the present invention in conjunction with roller track members.
Figure 15:
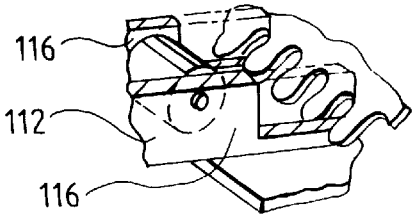
FIG. 15 is a rear perspective view taken along lines 15—15 of FIG. 14, with the front end of a roller track member partially broken away for clarity, showing the interface between the roller track member and the front track interface means.
Figure 16:
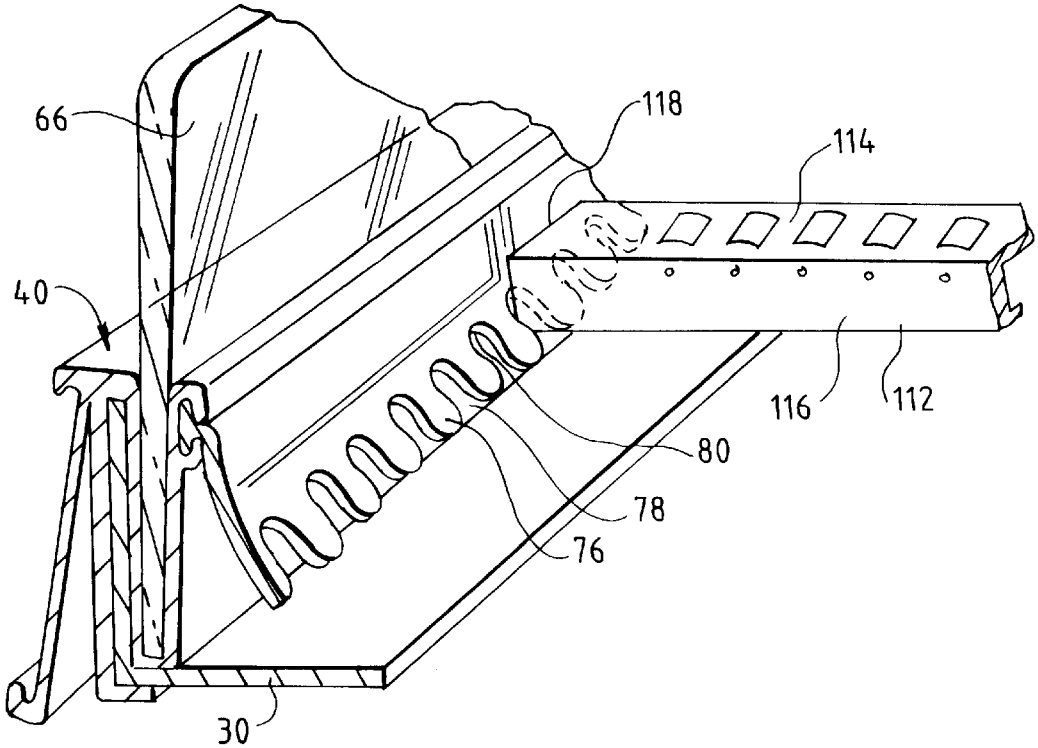
FIG. 16 is a perspective view, broken away, of an interface of a roller track member and the front track interface means of the shelf shown in FIG. 14, taken along line 16 of FIG. 14.

In addition, it is found that track members that do not have upstanding flow ribs on an upper surface can also be releasably secured within the shelf frame 12. For example, as shown in FIGS. 14–16, it is found that roller track members 112 having an upper elongated surface 114 with side support legs 116 can be used in the shelf frame 12 of the present invention. The preferred 0.2" center-to-center spacing of the gaps 78 between the tangs 76 permit the side support legs 116 of the roller track members 112 to act in substantially the same manner as the vertical divider wall members 102 described above. When the front (or rear) edges of the side support legs 116 of the roller track member are placed against the peaks 80 of two gaps 78 between tangs 76, and pressure is applied longitudinally to the roller track member 112, the associated front (or rear) track interface means deforms so that the opposite end of the roller track member 112 can be snapped into the opposite end of the shelf frame 12.

Retrofit Version for Existing Cantilevered Gondola-Type Shelving

It will be further appreciated that the indexable shelf of the present invention is not limited to use with new shelf systems having vertical shelf supports 18, 20, 22, 24 as shown in FIG. 1. Instead, the present invention may be used as a retrofit for existing shelving systems. For example, existing cantilevered, or so-called "gondola"-type retail shelving can be set on an incline, if so desired, and adapted to include the resilient front and rear track interface means of the present invention. Track members may then be installed at desired transverse locations and easily removed and repositioned to adjust the track column width for the gondola-type shelving.

Figure 11:
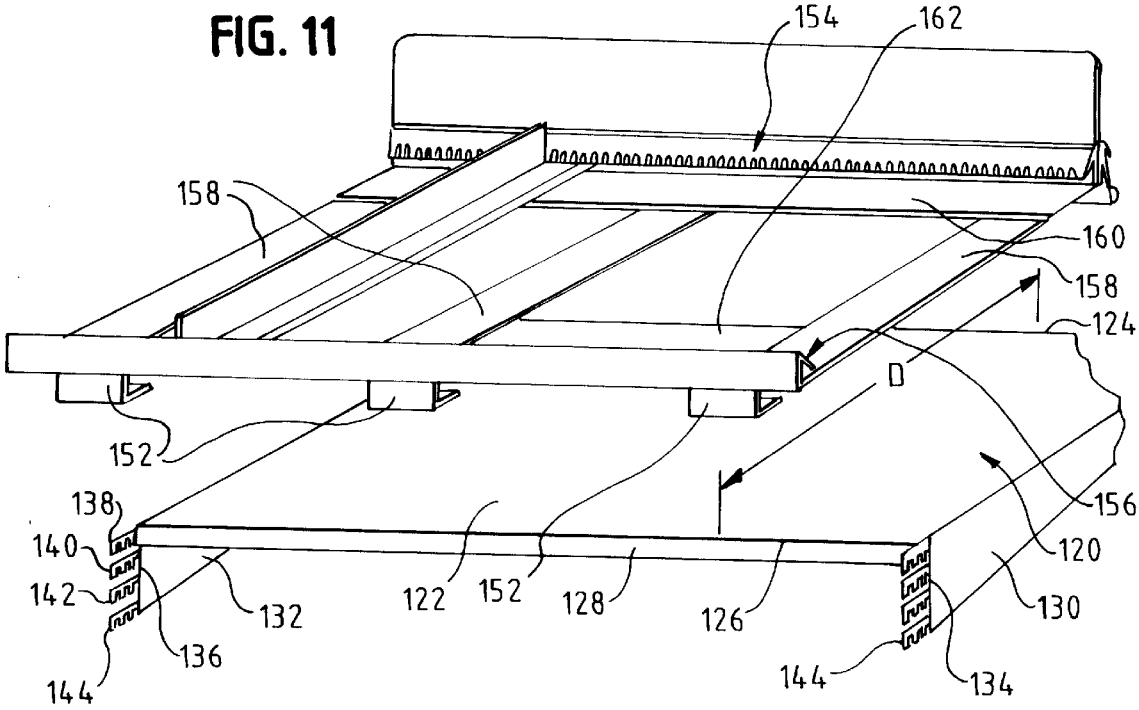
FIG. 11 is a rear perspective view of a conventional cantilevered gondola-type shelf equipped with a retrofit version of the indexable gravity flow shelf assembly of the present invention.
Figure 12:
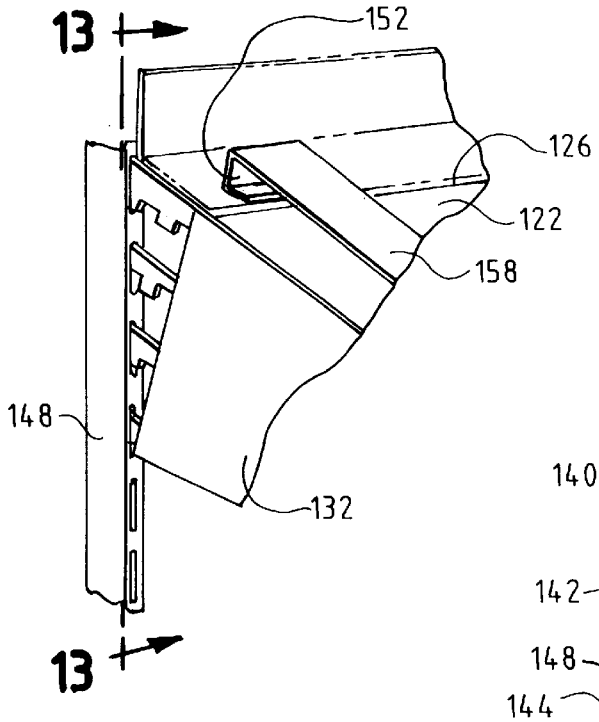
FIG. 12 is an enlarged front perspective view, broken away, of the connection of the shelf and retrofit indexable gravity flow shelf assembly of FIG. 11.
Figure 13:
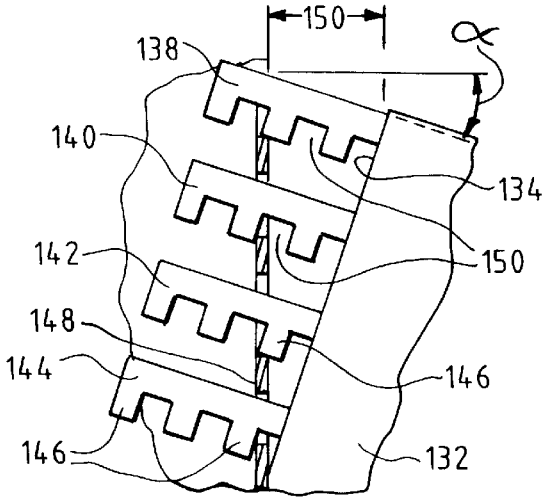
FIG. 13 is an enlarged left side view of the connection of the conventional cantilevered shelf of FIG. 11, taken along lines 13—13 of FIG. 12.

As shown in FIGS. 11–13, an existing conventional cantilevered gondola-type shelf 120 has a shelf surface 122 with a front edge 124 and a rear edge 126. An elongated rear flange 128 extends downwardly from the rear edge 126 a short distance, spanning the entire rear of the shelf 120. The shelf 120 includes two side legs 130, 132, having rear ends 134, 136, respectively. A plurality of integral adjustable mounting brackets 138, 140, 142, 144 extend rearwardly of the rear ends 134, 136, each including several teeth 146 used to latch the shelf 120 onto a pair of grooved mounting rails 148 mounted on a wall for conventional height-adjustable shelving.

Normally, the shelf 120 is mounted by directly aligning the teeth 146 of each mounting bracket 138–144 placed in the grooves of the mounting rails 148, to ensure the shelf surface 22 lies in a horizontal plane. However, by intentionally staggering the teeth 146 of the mounting brackets, as shown in FIGS. 12 and 13, i.e., by using more rearwardly-disposed teeth on the upper adjustable mounting brackets 138, 140 and closer (i.e., more-forward) teeth on the lower adjustable mounting brackets 142, 144, the shelf 120 can advantageously be securely mounted with the shelf surface 122 lying in an inclined plane, making an angle a with the horizontal.

Advantageously, the inclined mounting of the shelf 120 provides a gap 150 between the rear edge 126 of the shelf surface 122 and the vertical wall to which the grooved mounting rails 148 are fixed. This gap 150 allows for the insertion of an adapter means including one or more J-shaped hooks 152 at the rear edge 126 of the shelf surface 122 to grasp the rear flange 128. The J-shaped hooks 152 are associated with front and rear track interface means 154, 156. For example, the J-shaped hooks 152 may be integral extensions of elongated flat bar members 158 that are secured to, and extend between, L-shaped (in cross-section) front and rear rails 160, 162.

Front and rear track interface means 154, 156 mount to the front and rear rails 160, 162 just as in the shelf frame 12 described previously. Each of the front and rear track interface means 154, 156 includes a curved resilient comb member 164. The remaining details of the components and mode of operation of this retrofit version of our indexable gravity flow shelf are identical to the front and rear track interface means 68, 106 of the shelf frame 12 as described previously, and reference is made thereto.

While the present invention has been described with respect to particular preferred and alternate embodiments thereof, it is not intended to be limited thereto. Those of ordinary skill in the art will understand that variations can be made that are still within the scope of the following appended claims.

What is claimed is:

1. An indexable shelf comprising a front flexible track securement means and a rear flexible track securement means, each of said front and rear flexible track securement means comprising a resilient comb member having a plurality of track member receiving apertures, each of said resilient comb members being adapted to deform in a direction away from the opposite of said resilient comb members to releasably receive a portion of a track member, and being further adapted to spring back so as to restrain a track member received in said indexable shelf against transverse movement relative to the indexable shelf.

2. The indexable shelf of claim 1, wherein said shelf is mounted on a plurality of vertical support legs, and said front flexible track securement means is mounted at a lower height than said rear flexible track securement means.

3. The indexable shelf of claim 1, wherein said front flexible track securement means further comprises a front price tag molding extending substantially the width of said indexable shelf, said front price tag molding including a leading portion having indicia-receiving means therein, a secondary portion rearward of said leading portion, said secondary portion being adapted to receive a front stop plate therein, and a tertiary portion rearward of said secondary portion, said tertiary portion being adapted to interface with an upper portion of the resilient comb member of the front flexible track securement means.

4. The indexable shelf of claim 3, wherein said rear flexible track securement means further comprises a rear price tag molding extending substantially the width of said indexable shelf, said rear price tag molding being adapted to interface with an upper portion of the resilient comb member of said rear flexible track securement means.

5. The indexable shelf of claim 1, further comprising adapter means for securing said front and rear flexible track securement means to a cantilevered shelf.

6. The indexable shelf of claim 5, wherein said adapter means includes one or more hooks extending downwardly from a rear rail of said indexable shelf, said rear rail being secured to said rear price tag molding.

7. The indexable shelf of claim 6, wherein each of said one or more hooks is integral with a flat elongated bar extending between said rear rail and a front rail of said indexable shelf, said front rail being secured to said front price tag molding.

8. The indexable shelf of claim 1, in combination with a plurality of track members, each of said track members including a flat track strip extending between said front and rear flexible track securement means, said flat track strip having a lower surface, an upper surface, and a plurality of elongated flow ribs extending upwardly from said upper surface, each of said elongated flow ribs being received in one of said track member receiving apertures, whereby transverse movement of said track members is prevented.

9. The indexable shelf of claim 1, wherein said track receiving apertures are downwardly-open slots defined by a plurality of downwardly-extending tangs extending along said resilient comb member.

10. An indexable shelf for a gravity flow shelving system comprising:

an inclined shelf frame including a front rail, a rear rail, a left side rail and a right side rail;

a plurality of shelf track members, each of said shelf track members including a flat track strip having an upper surface and a lower surface and a plurality of elongated flow ribs extending substantially the length of said upper surface of the flat track strip; and resilient means for releasably securing each of said shelf track members to the shelf frame by restraining said elongated flow ribs against transverse movement.

11. The indexable shelf of claim 10, wherein said resilient means for releasably securing each of said shelf track members comprises a resilient comb member associated with each of said front and rear rails, each of said resilient comb members including a row of downwardly-extending tangs, each pair of said tangs defining a slot therebetween to receive said elongated flow ribs.

12. The indexable shelf of claim 11, wherein at least one of said resilient comb members associated with said front and rear rails is deformable at a desired location to accommodate insertion and removal of the flat track strip of each of said shelf track members.

13. The indexable shelf of claim 10, further comprising an indicia receiving means associated with said front rail.

14. The indexable shelf of claim 13, further comprising an indicia receiving means associated with said rear rail.

15. The indexable shelf of claim 10, further comprising a front stop plate extending substantially the width of said front rail, said front stop plate being substantially perpendicular to and extending upwardly from the plane of said inclined shelf frame.

16. The indexable shelf of claim 15, further comprising a rear filler piece extending substantially the width of said rear rail, said rear filler piece being substantially perpendicular to and extending upwardly from the plane of said inclined shelf frame.

17. The indexable shelf of claim 10, wherein said left and right side rails include means for adjusting the angle of incline of said shelf frame.

18. The indexable shelf of claim 17, wherein said means for adjusting the angle of incline of said shelf frame includes a plurality of downwardly-open U-shaped grooves associated with said left and right side rails, opposing pairs of said U-shaped grooves being adapted to receive a pair of opposing fasteners, each of said fasteners being connected to a vertical support of said gravity flow shelving system.

19. The indexable shelf of claim 11, wherein said slots defined by the tangs are separated by a center-to-center distance of about 0.2 inch.

20. An indexable shelf for a gravity flow shelving system comprising:

a front track interface means including a plurality of downwardly-extending, rearwardly-projecting front rail resilient tangs, each pair of adjacent said front rail resilient tangs defining a slot therebetween;

a rear track interface means including a plurality of downwardly-extending, forwardly-projecting rear rail resilient tangs and each pair of adjacent said rear rail resilient tangs defining a slot therebetween;

a pair of side rails extending between said front and rear track interface means;

means for mounting said indexable shelf on vertical support members of a shelf rack at an inclined angle;

at least one track member having a lower surface and an upper surface having plurality of upwardly-extending elongated ribs along the length of said upper surface, said track member being removably located and extending between said front and rear track interface means, each of said upwardly-extending elongated ribs engaging one of said slots defined by said front rail resilient tangs and one of said slots defined by said rear rail resilient tangs, whereby lateral movement of said track member is prevented.

21. The indexable shelf of claim 20, wherein each of said rear rail resilient tangs is oriented colinearly with a corresponding one of said front rail resilient tangs.

22. The indexable shelf of claim 21, wherein the two slots defined by said front and rear rail resilient tangs engaged by each of said elongated ribs are collinear.

23. The indexable shelf of claim 20, wherein said front track interface means further includes a price tag molding extending substantially the width of the indexable shelf, said price tag molding including a leading portion including an upper edge, a lower edge and indicia-receiving means;

a secondary portion integral with said upper edge of the leading portion, said secondary portion extending immediately rearwardly and downwardly from said upper edge and including at least a wall;

a tertiary portion including a first wall, a second wall spaced rearwardly from said first wall, and a floor segment connecting said first wall and said second wall, said first wall being integral with a top edge of said secondary portion and spaced rearwardly from said wall of said secondary portion, said tertiary portion forming a front stop plate receiving channel; and a resilient comb member extending downwardly and rearwardly from a top of said second wall, said resilient comb member including said front rail resilient tangs.

24. The indexable shelf of claim 23, wherein said secondary portion further includes a lowermost ledge extending rearwardly from said wall portion.

25. The indexable shelf of claim 23, further comprising a front rail that is generally L-shaped in cross section, said front rail extending between a front edge of said left and right rails and having an upstanding portion secured between said wall of the secondary portion and said first wall of the tertiary portion of the price tag molding.

26. The indexable shelf of claim 23, further including a front stop plate extending substantially the width of said shelf and received in said front stop plate receiving channel.

27. The indexable shelf of claim 23, wherein said resilient comb member is formed separately from said leading, secondary, and tertiary portions of said price tag molding, and the rear wall of the tertiary portion further includes means for securely interfacing with said resilient comb member.

28. The indexable shelf of claim 27, wherein said means for securely interfacing with said resilient comb member includes a channel generally C-shaped in cross-section extending rearwardly from said second wall of the tertiary portion and a corresponding rearward extension of an upper edge of said comb member that is substantially T-shaped in cross section, said T-shaped extension of the comb member being slidingly received in said C-shaped channel.

29. The indexable shelf of claim 23, wherein said rear track interface means further includes a rear price tag molding extending substantially the width of the indexable shelf, said rear price tag molding including a rear-most leading portion including an upper edge, a lower edge and indicia-receiving means;

a secondary portion integral with said upper edge of the leading portion, said secondary portion extending immediately forwardly and downwardly from said upper edge and including at least a wall;

a tertiary portion including a first wall, a second wall spaced forwardly of said first wall, and a floor segment connecting said first wall and said second wall, said first wall being integral with a top edge of said secondary portion and spaced forwardly from said wall of said secondary portion, said tertiary portion forming a rear stop plate receiving channel; and a resilient comb member extending downwardly and forwardly of a top of said second wall, said resilient comb member including said rear rail resilient tangs.

30. The indexable shelf of claim 29, wherein said secondary portion of the rear price tag molding further includes a lowermost ledge extending forwardly of said wall portion.

31. The indexable shelf of claim 29, further comprising a rear rail that is generally L-shaped in cross section, said rear rail extending between a rear edge of said left and right rails and having an upstanding portion secured between said wall of the secondary portion and said first wall of the tertiary portion of the rear price tag molding.

32. The indexable shelf of claim 23, further including a rear filler piece extending substantially the width of said shelf and received in said rear filler piece receiving channel.

33. The indexable shelf of claim 20, wherein said track member further comprises at least one vertical track wall extending substantially the length of said upper surface thereof.

34. The indexable shelf of claim 33, wherein one of said at least one vertical track walls is centrally located on said upper surface, whereby said upper surface is divided into at least two track regions.

35. The indexable shelf of claim 32, wherein at least one of said vertical track walls is located at a side edge of said upper surface.

36. The indexable shelf of claim 20, wherein said track member includes at least one elongated stiffening ridge extending downwardly from said lower surface.

37. The indexable shelf of claim 36, wherein each of said at least one stiffening ridges terminates rearwardly of a forward end of said track member and terminates forwardly of a rear end of said track member, whereby said track member lies flat against a rear rail and a front rail of said shelf.

38. A method for indexably arranging a track member including a flat track strip having an upper surface, a lower surface, a plurality of elongated flow ribs extending substantially the length of said upper surface of the flat track strip, and a vertical track wall member extending substantially the length of said upper surface, in an indexable shelf for a gravity flow shelving system comprising the steps of:

(a) positioning a leading edge of said vertical track wall member against a front track interface means of said shelf, said front track interface means including a plurality of downwardly-extending, rearwardly-projecting front rail resilient tangs, each pair of adjacent said front rail resilient tangs defining a slot therebetween and each of said slots including a peak;

(b) aligning each of said elongated ribs of said track member with a corresponding one of said slots, with said leading edge of the vertical track wall member in contact with the peak of one of said slots;

(c) applying force to said track member in a direction of said front track interface means, thereby causing a region of said front track interface means to temporarily deform in a forward direction, until said flat track strip passes below said resilient tangs, whereupon said elongated ribs are received in said corresponding slots and said front track interface means returns to its original shape;

(d) applying force substantially perpendicularly to a rear end of said track member and toward a rear track interface means including a plurality of downwardly-extending, forwardly-projecting rear rail resilient tangs, and each pair of adjacent said rear rail resilient tangs defining a rear slot therebetween, thereby causing said rear track interface means to temporarily deform in a rearward direction until said flat track strip passes below said rear rail resilient tangs, whereupon said elongated ribs are received in said corresponding rear slots and said rear track interface means returns to its original shape, whereby transverse movement of said track member is prevented.

39. The method of claim 38, wherein in said step (d), each of said rear rail resilient tangs is oriented collinearly with a corresponding one of said front rail resilient tangs.

40. The method of claim 39, wherein step (d) is performed prior to step (a).

* * * * *

UNITED STATES PATENT AND TRADEMARK OFFICE

CERTIFICATE OF CORRECTION

PATENT NO. : 6,332,547 B1
DATED : December 25, 2001
INVENTOR(S) : Shaw et al.

It is certified that error appears in the above-identified patent and that said Letters Patent is hereby corrected as shown below:

Title page,

Item [56], References Cited, U.S. PATENT DOCUMENTS, add:

| | | | |
|---|---|---|---|
| -- 6,047,647 | 04/2000 | Laraia, Jr. | 108/61 |
| 5,160,051 | 11/1992 | Bustos | 211/59.2 |
| D 286,596 | 11/1986 | Leo, Sr. | D6/476 |
| 584,167 | 06/1897 | Shanklin | |
| 1,046,488 | 12/1912 | Pauley | |
| 1,231,005 | 06/1917 | Erickson | |
| 2,483,769 | 07/1946 | Hickey | 312/140.3 |
| 2,820,684 | 02/1954 | Zadek et al. | 312/140.3 |
| 2,976,510 | 03/1961 | Blain | 339/17 |
| 3,408,128 | 10/1968 | Kump | 312/234 |
| 3,504,956 | 04/1970 | Schottland | 312/140.3 |
| 3,807,572 | 04/1974 | Luvara et al. | 211/10 |
| 4,476,985 | 10/1984 | Norberg et al. | 211/126 |
| 4,685,574 | 08/1987 | Young et al. | 211/59.2 |
| 5,148,927 | 09/1992 | Gebka | 211/184 |
| 5,203,463 | 04/1993 | Gold | 211/59.3 |
| 5,255,802 | 10/1993 | Krinke et al. | 211/184 |
| 5,582,305 | 12/1996 | Howell, Sr. et al. | 211/126 |

FOREIGN PATENT DOCUMENTS

| | | |
|---|---|---|
| 1,461,214 | 2/1967 | France -- |

Column 12,

Line 50, “an angle a” should read -- an angle α --.

Signed and Sealed this

First Day of April, 2003

JAMES E. ROGAN
*Director of the United States Patent and Trademark Office*